US009229416B2

(12) United States Patent
Shibuya

(10) Patent No.: US 9,229,416 B2
(45) Date of Patent: Jan. 5, 2016

(54) IMAGE FORMING APPARATUS HAVING A CLEANING DEVICE FOR AN IMAGE CARRIER

(71) Applicant: KYOCERA Document Solutions Inc., Osaka (JP)

(72) Inventor: Teppei Shibuya, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/519,595

(22) Filed: Oct. 21, 2014

(65) Prior Publication Data

US 2015/0117897 A1 Apr. 30, 2015

(30) Foreign Application Priority Data

Oct. 31, 2013 (JP) ..... 2013-227540
Mar. 27, 2014 (JP) ..... 2014-065324

(51) Int. Cl.
*G03G 21/00* (2006.01)

(52) U.S. Cl.
CPC ..... *G03G 21/0035* (2013.01)

(58) Field of Classification Search
CPC ..... G03G 21/0035
See application file for complete search history.

(56) References Cited

U.S. PATENT DOCUMENTS

| | | | | |
|---|---|---|---|---|
| 5,510,886 | A * | 4/1996 | Sugimoto et al. | 399/308 |
| 6,311,031 | B1 * | 10/2001 | Hirano | 399/101 |
| 7,379,686 | B2 * | 5/2008 | Nishikawa | 399/101 |
| 7,929,896 | B2 * | 4/2011 | Matayoshi et al. | 399/343 |
| 2007/0059027 | A1 * | 3/2007 | Ishikawa et al. | 399/101 |
| 2008/0304856 | A1 * | 12/2008 | Takahashi | 399/101 |
| 2009/0285589 | A1 * | 11/2009 | Nishikawa | 399/43 |
| 2010/0150601 | A1 * | 6/2010 | Sano et al. | 399/101 |
| 2010/0150602 | A1 * | 6/2010 | Sano et al. | 399/101 |
| 2012/0008973 | A1 * | 1/2012 | Sakakibara et al. | 399/71 |
| 2012/0195624 | A1 * | 8/2012 | Koujiri et al. | 399/101 |
| 2013/0142539 | A1 * | 6/2013 | Komiyama et al. | 399/101 |
| 2013/0142540 | A1 * | 6/2013 | Kaneko et al. | 399/101 |

FOREIGN PATENT DOCUMENTS

JP 2012-053175 A 3/2012

* cited by examiner

*Primary Examiner* — G. M. Hyder
(74) *Attorney, Agent, or Firm* — Studebaker & Brackett PC

(57) ABSTRACT

An image forming apparatus includes an image carrier and a cleaning device. The image carrier is rotated to carry a toner image. The cleaning device includes a cleaning member and an auxiliary cleaning member. To the cleaning member, a bias of a reversed polarity to a polarity of a remained toner adhered on a surface of the image carrier is applied. The auxiliary cleaning member is located at an upstream side from the cleaning member in a rotating direction of the image carrier. According to advance of whitening of the surface of the image carrier, the auxiliary cleaning member is made to come into contact with the surface of the image carrier or contact pressure of the auxiliary cleaning member with the surface of the image carrier is increased.

12 Claims, 10 Drawing Sheets

FIG. 5A

| CLEANING CURRENT | THE STATE OF INTERMEDIATE TRANSFERRING BELT | | | |
|---|---|---|---|---|
| μA | AT THE START OF USE | LOW WHITENING | MEDIUM WHITENING | HIGH WHITENING |
| 2.0 | ○ | ○ | ○ | ○ |
| 3.0 | ○ | ○ | ○ | ○ |
| 4.0 | ○ | ○ | ○ | ○ |
| 5.0 | ○ | ○ | ○ | × |
| 6.0 | ○ | ○ | ○ | × |
| 7.0 | ○ | ○ | ○ | × |
| 8.0 | ○ | ○ | ○ | × |
| 9.0 | ○ | ○ | × | × |
| 10.0 | ○ | ○ | × | × |
| 11.0 | ○ | × | × | × |
| 12.0 | ○ | × | × | × |
| 13.0 | ○ | × | × | × |
| 14.0 | ○ | × | × | × |
| 15.0 | ○ | × | × | × |
| 16.0 | ○ | × | × | × |

WITH BAR BRUSH

FIG. 5B

| CLEANING CURRENT | THE STATE OF INTERMEDIATE TRANSFERRING BELT | | | |
|---|---|---|---|---|
| μA | AT THE START OF USE | LOW WHITENING | MEDIUM WHITENING | HIGH WHITENING |
| 2.0 | ○ | ○ | ○ | × |
| 3.0 | ○ | ○ | × | × |
| 4.0 | ○ | ○ | × | × |
| 5.0 | ○ | ○ | × | × |
| 6.0 | ○ | ○ | × | × |
| 7.0 | ○ | ○ | × | × |
| 8.0 | ○ | ○ | × | × |
| 9.0 | ○ | × | × | × |
| 10.0 | ○ | × | × | × |
| 11.0 | ○ | × | × | × |
| 12.0 | ○ | × | × | × |
| 13.0 | ○ | × | × | × |
| 14.0 | ○ | × | × | × |
| 15.0 | ○ | × | × | × |
| 16.0 | ○ | × | × | × |

WITHOUT BAR BRUSH

IMAGE FORMING APPARATUS HAVING A CLEANING DEVICE FOR AN IMAGE CARRIER

INCORPORATION BY REFERENCE

This application is based on and claims the benefit of priority from Japanese Patent application No. 2013-227540 filed on Oct. 31, 2013, and Japanese Patent application No. 2014-065324 filed on Mar. 27, 2014, the entire contents of which are incorporated herein by reference.

BACKGROUND

The present disclosure relates to an electrographic image forming apparatus.

An electrographic image forming apparatus applying an intermediate transfer type in order to form a color image is widely known. The intermediate transfer type image forming apparatus includes a plurality of photosensitive bodies, an intermediate transferring belt, a first transferring part, a second transferring part and a cleaning device. The photosensitive bodies carry toner images of a plurality of colors. The intermediate transferring belt as an image carrier comes into contact with the photosensitive bodies. The first transferring part transfers the toner image on each photosensitive body to a surface of the intermediate transferring belt. The second transferring part transfers the color toner images on the intermediate transferring belt onto a sheet in a lump. The cleaning device removes a toner not transferred onto the sheet (hereinafter, called as a "remained toner") from the surface of the intermediate transferring belt.

As the cleaning device of the intermediate transfer type image forming apparatus, a bias cleaning manner is widely applied. The bias cleaning manner is a manner removing the remained toner from the surface of the intermediate transferring belt by a cleaning member to which a bias of a reversed polarity to a charged polarity of the remained toner is applied. The intermediate transferring belt has a plurality of layers including an elastic layer for the purpose of lifetime extension and image quality enhancement of an output image.

The intermediate transfer type image forming apparatus has excellent productivity because of transferring the color toner images onto the surface of the intermediate transferring belt in a lump, but tends to increase an amount of the remained toner on the intermediate transferring belt because of overlapping the toner images of respective colors on the surface of the intermediate transferring belt. In a case of overlapping the toners to form the color image, because the charging amount of the overlapped toners is increased, voltage required for transferring is also increased. Due to deterioration of a developer, a polarity of the remained toner may become reversed from that in developing process or become close to no polarity. If these factors are simultaneously or repeatedly caused, there is a possibility that the cleaning device including the above-mentioned cleaning member cannot efficiently remove the remained toner from the surface of the intermediate transferring belt.

Thereupon, a cleaning device efficiently removing the remained toner from the surface of the intermediate transferring belt is proposed. For example, there is the cleaning device which includes a cleaning member coming into contact with the intermediate transferring belt and an auxiliary cleaning member coming into contact with the intermediate transferring belt at an upstream side from the cleaning member. The auxiliary cleaning member frictionally charges the remained toner to a predetermined polarity (a polarity in the developing process). Because of this, the cleaning member easily removes the remained toner from the surface of the intermediate transferring belt by the bias cleaning manner.

Recently, from a viewpoint of reduction of cost and reuse of resources, low quality sheet, such as a recycled paper, may be used. In a region manufacturing the sheet by manufacturing equipment with insufficient performance, it may be necessary to use the low quality sheet.

Such a low quality sheet may contain a large quantity of talc or calcium carbonate as a surface preparation agent or a filler. If image forming operation is repeatedly carried out to such a sheet, paper dust containing the talc or the calcium carbonate is adhered onto a surface of an image carrier. Particularly, if the above-mentioned low quality sheet is used at a stage before whitening of the surface of the image carrier (a phenomenon in which the surface of the image carrier is whitened mainly because external additive is accumulated onto the surface of the image carrier) reaches a predetermined level, a large quantity of the paper dusts containing the talc or the calcium carbonate are adhered onto the surface of the image carrier. If the paper dust on the surface of the image carrier is frictionally charged by the auxiliary cleaning member, the cleaning member and auxiliary cleaning member are clogged with the paper dust. Because of this, functionality of the auxiliary cleaning member frictionally charging the remained toner is deteriorated.

Because the cleaning member is contracted as the use is continued, functionality of the cleaning member mechanically scraping the remained toner is deteriorated. The functionality deterioration of the cleaning member hinders image forming from being carried out excellently on a long time. The paper dust with which the auxiliary cleaning member is clogged may be hardened to scrape a surface layer of the image carrier. In such a case, there is a trouble that a friction coefficient at a scraped portion is increased and second transfer performance of the image carrier is deteriorated.

SUMMARY

In accordance with an embodiment of the present disclosure, an image forming apparatus includes an image carrier and a cleaning device. The image carrier is rotated to carry a toner image. The cleaning device includes a cleaning member and an auxiliary cleaning member. To the cleaning member, a bias of a reversed polarity to a polarity of a remained toner adhered on a surface of the image carrier is applied. The auxiliary cleaning member is located at an upstream side from the cleaning member in a rotating direction of the image carrier. According to advance of whitening of the surface of the image carrier, the auxiliary cleaning member is made to come into contact with the surface of the image carrier or contact pressure of the auxiliary cleaning member with the surface of the image carrier is increased.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 5A is a table showing performance of the cleaning device in a case where the bar brush exists, in the color printer according to the first embodiment of the present disclosure. FIG. 5B is a table showing performance of the cleaning device in a case where the bar brush does not exist, in the color printer according to the first embodiment of the present disclosure.

DETAILED DESCRIPTION

In the following, embodiments of the disclosure will be described with reference to the accompanying drawings.

(First Embodiment)

Figure 1:
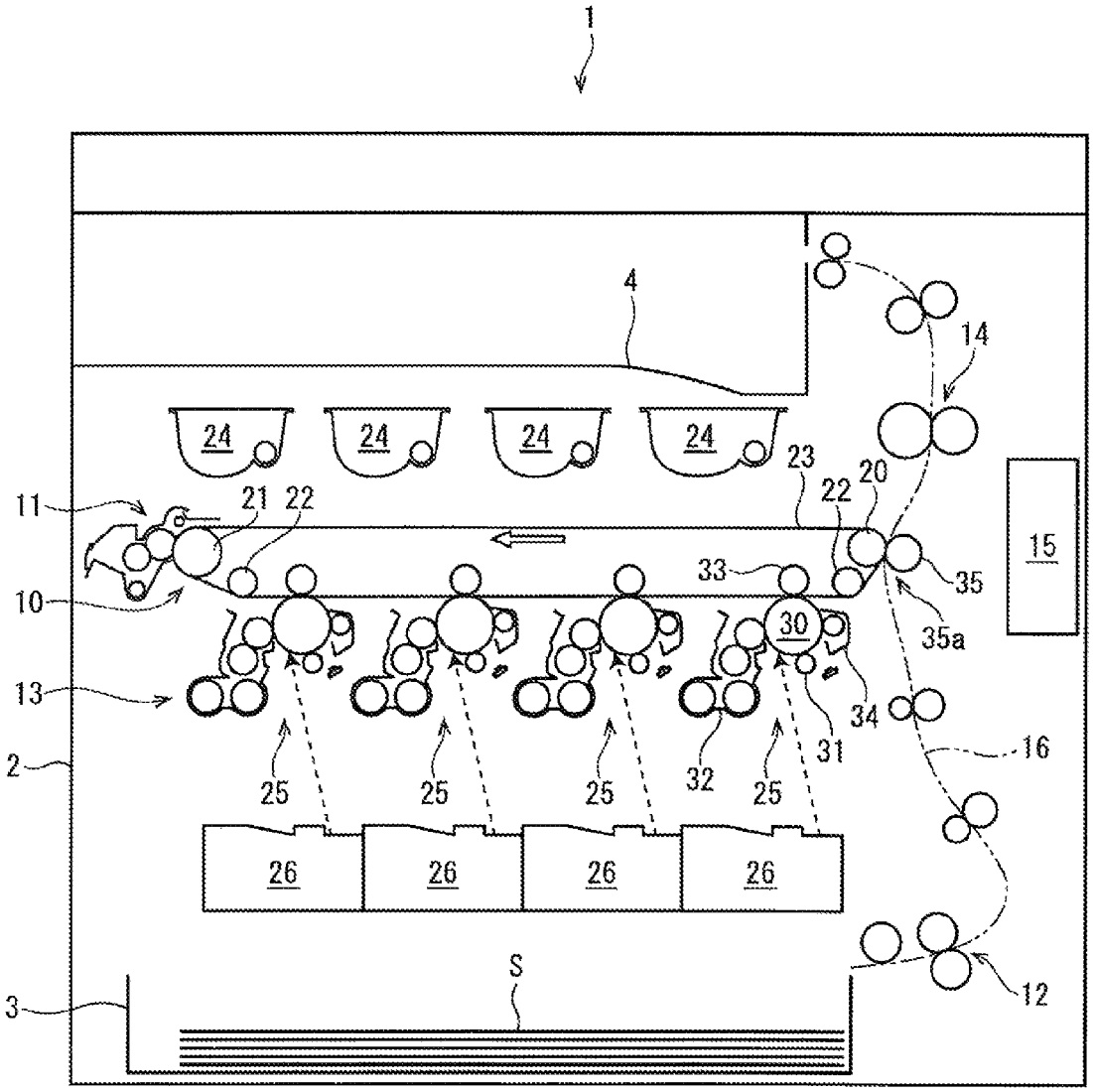
FIG. 1 is a sectional view schematically showing an inside structure of a color printer according to a first embodiment of the present disclosure.
Figure 2:
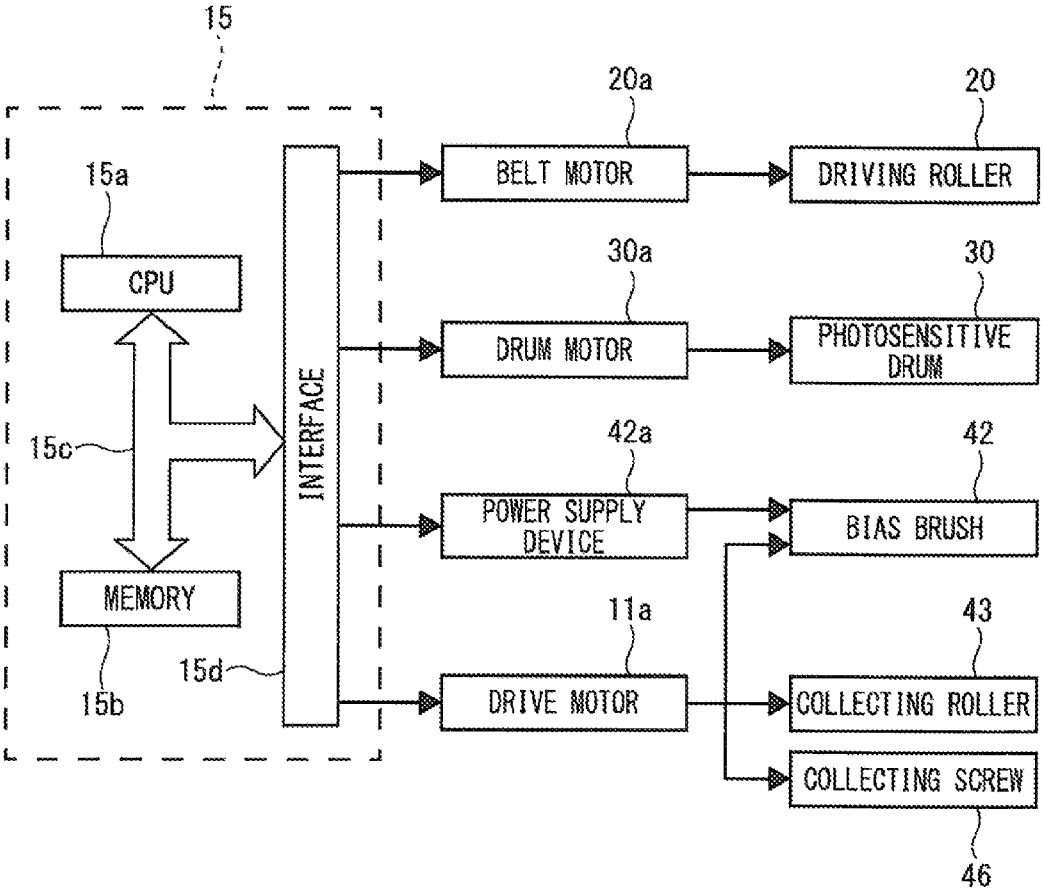
FIG. 2 is a block diagram showing an electric structure of the color printer according to the first embodiment of the present disclosure.

With reference to FIGS. 1 and 2, the entire structure of a color printer 1 (an image forming apparatus) will be described. FIG. 1 is a sectional view schematically showing an inside structure of the color printer 1. FIG. 2 is a block diagram showing an electric structure of the color printer 1. In the embodiment, it will be described so that the front side of the color printer 1 is positioned at the near side on FIG. 1, for convenience of explanation.

As shown in FIG. 1, the color printer 1 includes a roughly box-formed apparatus main body 2, a sheet feeding cartridge 3 arranged in a lower part of the apparatus main body 2 and an ejected sheet tray 4 arranged in an upper part of the apparatus main body 2.

The color printer 1 includes an intermediate transferring unit 10, a cleaning device 11, a sheet feeding part 12, an image forming part 13, a fixing device 14 and a controlling device 15 in the apparatus main body 2.

The intermediate transferring unit 10 is arranged at a roughly center part inside the apparatus main body 2. The cleaning device 11 is arranged at a left side of the intermediate transferring unit 10. The sheet feeding part is arranged near a right side of the sheet feeding cartridge 3 to feed a sheet S in the sheet feeding cartridge 3 to a conveying path 16. The image forming part 13 is arranged below the intermediate transferring unit 10. The fixing device 14 is arranged at a downstream side of the conveying path 16. The controlling device 15 is arranged to collectively control each component of the color printer 1.

The intermediate transferring unit 10 includes a driving roller 20, a following roller 21, a pair of tensioning rollers 22 and an intermediate transferring belt 23 (an image carrier). The driving roller 20 is arranged at one end side (a right end side) in a longitudinal direction of the intermediate transferring unit 10. The following roller 21 is arranged at another end side (a left end side) in the longitudinal direction of the intermediate transferring unit 10. The tensioning rollers 22 are arranged at a left lower side of the driving roller 20 and a right lower side of the following roller 21. The intermediate transferring belt 23 is wound around the respective rollers 20, 21 and 22.

The driving roller 20 is connected to a belt motor 20*a* via a gear train (not shown) (refer to FIG. 2). The following roller 21 is biased in a left direction by a coil spring 21*a* (refer to FIG. 3). To the intermediate transferring belt 23, a predetermined tension is applied by the following roller 21 and the pair of tensioning rollers 22. The intermediate transferring belt 23 is rotated according to driving of the belt motor 20*a* in left-handed rotation on FIG. 1.

The intermediate transferring belt 23 is composed of, for example, a base material layer, an elastic layer provided around an outer circumference face of the base material layer and a release layer arranged so as to cover the elastic layer. The base material layer is made of, for example, polyvinylidene fluoride, polyimide resin or the like. The elastic layer is made of, for example, hydrin rubber, chloroprene rubber, polyurethane rubber or the like. The release layer is made of, for example, acryl, silicone, fluorine-based resin or the like.

The cleaning device 11 removes a remained toner adhered on a surface of the intermediate transferring belt 23. The cleaning device 11 is described in detail later.

The image forming part 13 is configured so as to carry out image forming process by using replenishment developers of four colors (yellow, magenta, cyan and black) contained in four toner containers 24. The image forming part 13 includes four drum units 25 and four exposure devices 26. The developer contained in the toner container 24 is so-called two-component developer consisting of a toner and a carrier.

The four drum units 25 are arranged in parallel in left and right directions below the intermediate transferring belt 23. Because the four drum units 25 have similar configurations, in the following description, one drum unit 25 will be exemplified.

The drum unit 25 includes a photosensitive drum 30 (a photosensitive body) supported rotatably, and a charging device 31, a developing device 32, a first transferring roller 33 and a drum cleaning device 34 arranged around the photosensitive drum 30 in order of transfer processes.

The photosensitive drum 30 is arranged so as to face to the first transferring roller 33 across the intermediate transferring belt 23 from a lower side. The photosensitive drum 30 comes into contact with the surface of the intermediate transferring belt 23. The photosensitive drum 30 is connected to a drum motor 30*a* via a gear train (not shown) (refer to FIG. 2). At the right side of the driving roller 20, a second transferring roller 35 is arranged so as to face to the driving roller 20 across the intermediate transferring belt 23. Between the second transferring roller 35 and intermediate transferring belt 23, a second transferring nip part 35*a* is formed.

As shown in FIG. 2, the controlling device 15 includes a central processing unit (CPU) 15*a*, a memory 15*b*, a bus 15*c* and an interface 15*d*.

The CPU 15*a* executes operation process in accordance with each program or the like. The memory 15*b* has a ROM (Read Only Memory), a RAM (Random Access Memory), a flush memory and others. The memory 15*b* stores programs used for the operation process in the CPU 15*a*, rated values of various biases and others. The memory 15*b* temporarily stores operation result in the CPU 15*a* and others. The bus 15*c* connects the CPU 15*a*, memory 15*b* and interface 15*d*. To the interface 15*d*, various controlled objects, such as the belt motor 20*a* and drum motor 30*a*, are electrically connected. Additionally, to the interface 15*d*, a driving device, such as another motor, a power source and others may be connected and suitably controlled by the CPU 15*a*, but their illustrations are omitted.

Now, the operation of the color printer 1 will be described. When the power is supplied to the color printer 1, the controlling device 15 executes initialization of various parameters and others. In the color printer 1, when image data is inputted and a printing start is directed from a personal computer or the like connected with the color printer 1, the controlling device 15 executes image forming operation as follows.

Each exposure device 26 carries out exposure corresponding to the image data (refer to a dashed line arrow in FIG. 1) onto a surface of each photosensitive drum 30 electrically charged to predetermined potential by each charging device 31 to form an electrostatic latent image. Each developing device 32 develops the electrostatic latent image to a toner image by the toner supplied from each toner container 24. That is, the four photosensitive drums 30 respectively carry toner images of different colors (for example, the toner images of four colors). Each first transferring roller 33 works to first-transfer the toner image from the photosensitive drum 30 onto the intermediate transferring belt 23 in accordance with applying of first transferring bias. The intermediate transferring belt 23 is rotated to carry the toner images of the respective colors first-transferred from the four photosensitive drums 30 in sequence. Thereby, the toner image of full color is formed on the surface of the intermediate transferring belt 23.

On the other hand, the sheet S fed from the sheet feeding cartridge 3 is conveyed in the conveying path 16 to pass through the second transferring nip part 35*a*. The second transferring roller 35 works to transfer the toner image of full color onto the sheet S in accordance with applied second transferring bias. The fixing device 14 fixes the toner image onto the sheet S. The sheet S after fixing process is ejected to the ejected sheet tray 4. The drum cleaning device 34 removes a toner remained on the surface of the photosensitive drum 30 after transferring.

Figure 3:
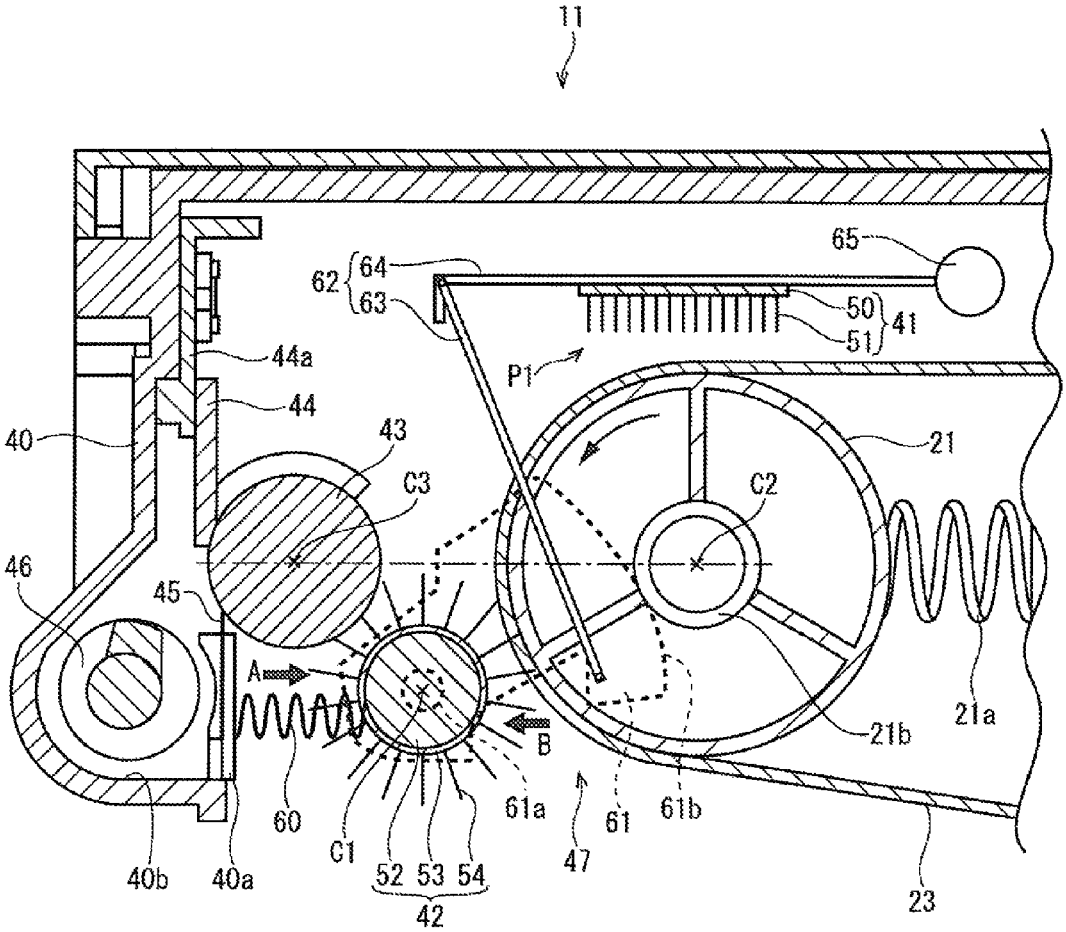
FIG. 3 is a sectional view schematically showing a cleaning device, in a condition where a bar brush is located at a first position, of the color printer according to the first embodiment of the present disclosure.
Figure 4:
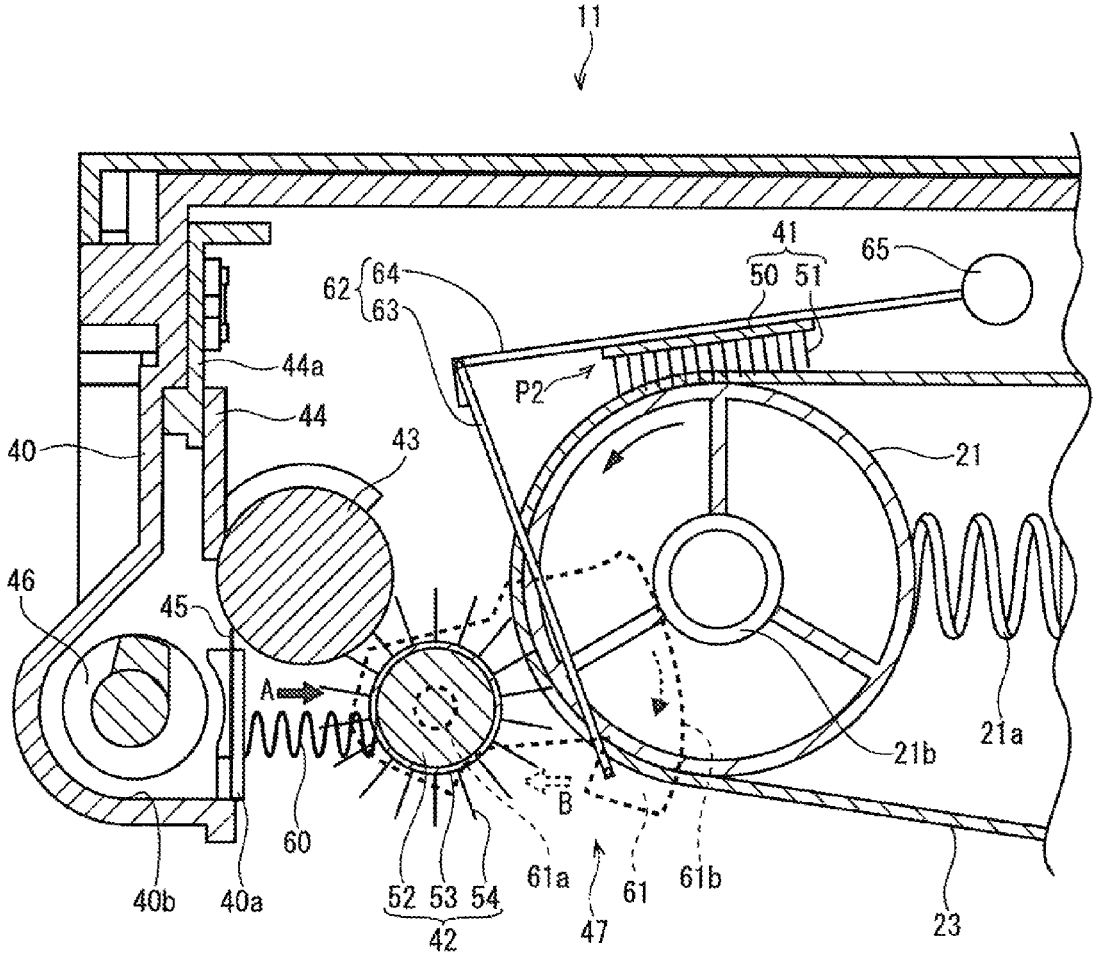
FIG. 4 is a sectional view schematically showing the cleaning device, in a condition where the bar brush is located at a second position, of the color printer according to the first embodiment of the present disclosure.

Next, with reference to FIGS. 3 and 4, the cleaning device 11 will be described. FIG. 3 is a sectional view schematically showing the cleaning device 11 in a condition where a bar brush 41 is located at a first position P1. FIG. 4 is a sectional view schematically showing the cleaning device 11 in a condition where the bar brush 41 is located at a second position P2.

As shown in FIG. 3, the cleaning device 11 includes a casing 40, the bar blush 41 (an auxiliary cleaning member), a bias brush 42 (a cleaning member), a collecting roller 43, a blade 44, a regulating sheet 45, a collecting screw 46 and a moving device 47.

The casing 40 is formed in a roughly box-like shape with an opened right lateral face. An upper part of the casing 40 is covered by an openable/closable lid body (not shown). For example, by opening the lid body, a worker can carry out maintenance and others of the inside of the casing 40.

The bar brush 41 is located at an upstream side from the bias brush 42 in a rotating direction of the intermediate transferring belt 23. The bar brush 41 is arranged so as to face to an upper side of the following roller 21 across the intermediate transferring belt 23.

The bar brush 41 has a base part 50 extending in forward and backward direction and a plurality of charging brush bristles 51 implanted on a lower face of the base part 50.

The base part 50 is made of, for example, synthetic resin material. Each charging brush bristle 51 is made of, for example, polyester-based or acryl-based insulating yarn. It is preferable that each charging brush bristle 51 is positioned (electrically charged) at a reversed side to charged polarity of the toner in a charging series. For example, in a case where the toner is a positive charged toner, it is preferable that each charging brush bristle 51 is positioned (electrically charged) at a minus side from the toner in the charging series. Thereby, the bar brush 41 electrically charges the remained toner adhered on the surface of the intermediate transferring belt 23. Each charging brush bristle 51 is not restricted by the insulating yarn. Each charging brush bristle 51 may be made of electroconductive yarn containing carbon. In such a case, a thickness of the electroconductive yarn is preferably equal to or more than 2 denier.

The bias brush 42 is arranged so as to face to a left lower side of the following roller 21 across the intermediate transferring belt 23. The bias brush 42 is arranged so that its center C1 is positioned lower than a rotation center C2 of the following roller 21 supporting the intermediate transferring belt 23 (refer to a one-dot chain line in FIG. 3).

The bias brush 42 has a cylindrical body 53 provided around a brush shaft 52 and a plurality of removing brush bristles 54 implanted on an outer circumference face of the cylindrical body 53.

The brush shaft 52 is extended in the forward and backward directions and rotatably supported by both front and rear walls of the casing 40. The cylindrical body 53 is press-fitted and fixed to the outer circumference face of the brush shaft 52 and rotated around an axis. Each removing brush bristle 54 is made of, for example, polyester-based, nylon-based or acryl-based electroconductive yarn. A distal end portion of each removing brush bristle 54 comes into contact with the surface of the intermediate transferring belt 23. Rigidity of the removing brush bristle 54 is preferably set lower (smaller) than rigidity of each charging brush bristle 51 of the bar brush 41.

The bias brush 42 is electrically connected to a power supply device 42*a* (refer to FIG. 2). The power supply device 42*a* is electrically connected to the interface 15*d* (refer to FIG. 2). To the bias brush 42, a bias of a reversed polarity to a polarity of the remained toner is applied from the power supply device 42*a* controlled by the controlling device 15.

The collecting roller 43 is arranged at a left upper side of the bias brush 42. A center C3 of the collecting roller 43 is positioned at roughly same level as the rotation center C2 of the following roller 21. The collecting roller 43 is extended in the forward and backward directions and rotatably supported by both front and rear walls of the casing 40. A surface layer portion of the collecting roller 43 is made of, for example, rubber or soft synthetic resin. An outer circumference face of the collecting roller 43 comes into contact with each removing brush bristle 54 of the bias brush 42.

The blade 44 is, for example, formed in a plate-like shape and made of synthetic resin. The blade 44 is arranged at a left upper side of the collecting roller 43. A proximal end portion of the blade 44 is attached to the casing 40 via an attachment 44*a*. A distal end portion of the blade 44 comes into contact with the outer circumference face of the collecting roller 43.

The regulating sheet 45 is, for example, formed in a film-like shape and made of synthetic resin. The regulating sheet 45 is arranged at a left lower side of the collecting roller 43. A proximal end portion of the regulating sheet 45 is attached to a sheet attaching part 40*a* of the casing 40. A distal end portion of the regulating sheet 45 comes into contact with the outer circumference face of the collecting roller 43. The regulating sheet 45 partitions the inside of the casing 40 to provide a screw storing chamber 40*b* at its left side.

The collecting screw 46 has a spiral screw fin on an outer circumference face of a rotation shaft extending in the forward and backward directions. The collecting screw 46 is stored in the screw storing chamber 40*b* and rotatably supported by both front and rear walls of the casing 40. The bias brush 42, collecting roller 43 and collecting screw 46 are connected to a drive motor 11*a* via a gear train (not shown) (refer to FIG. 2). The drive motor 11*a* is electrically connected to the interface 15*d* (refer to FIG. 2).

The moving device 47 is arranged to move the bar brush 41 between a first position P1 (refer to FIG. 3) where the bar brush 41 is separated from the surface of the intermediate transferring belt 23 and a second position P2 (refer to FIG. 4) where the bar brush 41 comes into contact with the surface of the intermediate transferring belt 23 by predetermined pressure. The moving device 47 includes a first biasing member 60, a touching member 61 and a joining member 62. The moving device 47 is arranged, for example, at the front side inside the casing 40.

The first biasing member 60 is composed of so-called coil spring. A left end part of the first biasing member 60 is connected to a sheet attaching part 40*a* of the casing 40. A right end part of the first biasing member 60 is connected to a frame (not shown) pivotally supporting the biasing brush 42. The first biasing member 60 biases the bias brush 42 with respect to the sheet attaching part 40*a* as a receiving part so as to make the bias brush 42 come into contact with the surface of the intermediate transferring belt 23. The right end part of the first biasing member 60 may be connected to a left end part of the touching member 61.

The touching member 61 is formed in a plate-like shape and made of synthetic resin material with excellent slidability. The touching member 61 is formed in a roughly hook-like shape bent downwardly at a right side, as viewed from the front side. The touching member 61 has a left end part (one end part) turnably connected to the bias brush 42 and a right end part (another end part) coming into contact with a rotation axis part 21*b* of the following roller 21 as a rotation axis part of the intermediate transferring belt 23. In detail, the touching member 61 is turned in upward and downward directions around a rotation axis part 61*a* coaxial with the brush shaft 52 of the bias brush 42 as a fulcrum. The touching member 61 has a contacting face 61*b* coming into contact with an outer circumference face of the rotation axis part 21*b* of the following roller 21. The contacting face 61*b* is formed in a roughly arc shape as viewed from the front side.

The joining member 62 joins the touching member 61 and bar brush 41. The joining member 62 has an arm part 63 and a brush supporting part 64.

The arm part 63 is formed in a roughly bar shape extending in the upward and downward directions and made of metal or the like. A lower end part of the arm part 63 is turnably joined to a hook portion at a right side of the touching member 61. The arm part 63 is extended from a lower end part to a left upper side.

The brush supporting part 64 is formed in a roughly bar shape extending in the left and right directions and made of metal or the like. A right end part of the brush supporting part 64 is supported turnably around a swinging axis part 65 as a fulcrum with respect to the casing 40. An intermediate part of the brush supporting part 64 supports an upper face of the base part 50 of the bar brush 41. A left end part of the brush supporting part 64 is turnably joined to an upper end part of the arm part 63. That is, the touching member 61, arm part 63 and brush supporting part 64 constitute a link mechanism. Thereby, the bar brush 41 is swung together with the joining member 62 (the brush supporting part 64) in the upward and downward directions. An angle between the arm part 63 and brush supporting part 64 is an acute angle.

Next, an action (remained toner removing process) of the cleaning device 11 will be described. In the following description, the remained toner adhered on the surface of the intermediate transferring belt 23 is supposed to be electrically charged to mainly positive. The power supply device 42*a* is supposed to be controlled by the controlling device 15 to apply a bias of a negative polarity (a reversed polarity to the polarity of the remained toner) to the bias brush 42.

As shown in FIG. 3, each removing brush bristle 54 of the bias brush 42 comes into contact with the surface of the intermediate transferring belt 23. Therefore, the bias brush 42 receives reaction force B from the intermediate transferring belt 23 in accordance with biasing force A which the bias brush 42 receives from the first biasing member 60 and own elastic force of the bias brush 42. That is, the reaction force B acts between the bias brush 42 and intermediate transferring belt 23 on the basis of the elastic force of the bias brush 42 (each removing brush bristle 54). In a case where the reaction force B is larger than the biasing force A of the first biasing member 60, the touching member 61 is pressed to the rotation axis part 21*b* of the following roller 21 in non-turnable state by the reaction force B and keeps the bar brush 41 to the first position P1 via the joining member 62.

For example, if the biasing brush 42 is new article which is not worn, since the elastic force of the biasing brush 42 is strong (large), the reaction force B becomes larger than the biasing force A of the first biasing member 60. In such a condition (A<B), the contacting face 61*b* of the touching member 61 is pressed to a circumference face of the rotation axis part 21*b* of the following roller 21 and kept in a non-turnable state. Simultaneously, the bar brush 41 connected to the touching member 61 via the joining member 62 is kept at the first position P1. That is, the bar brush 41 is separated upwardly from the surface of the intermediate transferring belt 23.

In such a condition, if image forming process is carried out, each removing brush bristle 54 of the bias brush 42 is relatively slid on the surface of the rotating intermediate transferring belt 23. Each removing brush bristle 54 of the bias brush 42 adsorbs the remained toner adhered on the intermediate transferring belt 23 by electrostatic adsorption force acting between each removing brush bristle 54 and the remained toner. Thereby, the remained toner is removed from the surface of the intermediate transferring belt 23.

The collecting roller 43 receives the remained toner shifted to each removing brush bristle 54 of the bias brush 42. The blade 44 scrapes the remained toner shifted to the collecting roller 43. The collecting screw 46 conveys the scraped remained toner to a collecting box (not shown). The remained toner is accumulated in the collecting box.

Incidentally, on the surface of the intermediate transferring belt 23, whitening (a phenomenon of gradually becoming white by the adhered substance) is advanced according to repeat of the image forming process. Because each removing brush bristle 54 of the bias brush 42 comes into slide contact with the surface of the intermediate transferring belt 23, it is worn according to repeat of the remained toner removing process. If wear (deterioration) of the bias brush 42 is advanced according to the advance of the whitening of the surface of the intermediate transferring belt 23, the elastic force of the bias brush 42 is weakened. Then, the reaction force B becomes equal to or less than the biasing force A of the first biasing member 60 (A≥B). The external diameter of the bias brush 42 becomes slightly smaller than the new article.

As shown in FIG. 4, in a case where the reaction force B becomes equal to or less than the biasing force A of the first biasing member 60, the touching member 61 is turned downwardly and moves the bar brush 41 from the first position P1 to the second position P2 via the joining member 62. That is, if the pressing force of the contacting face 61*b* of the touching member 61 with respect to the rotation axis part 21*b* of the following roller 21 is reduced, the touching member 61 is turned downwardly around the rotation axis part 61*a* as a fulcrum by its empty weight or weight of the joining member 62 (right-handed rotation on FIG. 4). Accompanying to the turning of the touching member 61, the bar brush 41 connected to the touching member 61 via the joining member 62 is moved from the first position P1 to the second position P2. That is, the joining member 62 (the brush supporting part 64) is turned around the swinging axis part 65 as the fulcrum in the left-handed rotation on FIG. 4. Thereby, the bar brush 41 (each charging brush bristle 51) comes into contact with the surface of the intermediate transferring belt 23 from an upper side. Thus, in the embodiment, it is configured, in accordance with the advance of the whitening of the surface of the intermediate transferring belt 23, so as to make the bar brush 41 come into contact with the surface of the intermediate transferring belt 23.

In such a condition, if image forming process is carried out, each charging brush bristle 51 of the bar brush 41 is relatively slid on the surface of the intermediate transferring belt 23 being rotated. For example, the charging brush bristle 51 of the bar brush 41 comes into contact with the remained toner charged to the negative polarity or the remained toner with a polarity extremely close to zero to electrically charge the remained toner to the positive polarity.

Subsequently, as described already, the bias brush (each removing brush bristle 54) adsorbs the remained toner charged to the positive polarity. That is, it removes the remained toner from the surface of the intermediate transferring belt 23. Then, the remained toner is accumulated in the collecting box by action of the collecting roller 43, blade 44 and collecting screw 46.

Next, with reference to FIGS. 5A and 5B, relationship between performance of the cleaning device 11 and existence of the bar brush 41 in the color printer according to the first embodiment will be described.

The terms and others in FIGS. 5A and 5B are described as follows. The term of "WITH BAR BRUSH" means a case of carrying out the remained toner removing process by using the bar brush 41 and bias brush 42. The term of "WITHOUT BAR BRUSH" means a case of carrying out the remained toner removing process by using the bias brush 42. The term of "CLEANING CURRENT" means an electric current supplied from the power supply device 42*a* to the bias brush 42. The terms of "LOW WHITENING", "MEDIUM WHITENING" and "HIGH WHITENING" mean degrees of the whitening of the surface of the intermediate transferring belt 23. The symbol of "○" means that the performance of the cleaning device 11 is sufficiently delivered and no part of the image transferred on the sheet S is remained on next sheet S. The symbol of "×" means that the performance of the cleaning device 11 is not sufficiently delivered and a part of the image transferred on the sheet S is remained on next sheet S.

Referring to the time at the start of use (the time when the whitening does not yet occur) of the intermediate transferring belt 23, the cleaning device 11 delivers sufficient performance regardless whether or not the bar brush 41 exists. By contrast, if the whitening of the surface of the intermediate transferring belt 23 occurs, the cleaning device 11 delivers more excellent performance in a case "WITH BAR BRUSH" than a case "WITHOUT BAR BRUSH". Therefore, it can be confirmed that remained toner removing process can be carried out excellently by using the bias brush 42 and bar brush 41 after the whitening occurs.

In accordance with the color printer 1 as described above according to the first embodiment, in an initial condition where the performance of the bias brush 42 can be secured (e.g. in the new article), the remained toner is removed from the surface of the intermediate transferring belt 23 mainly by function of the bias brush 42 without actively delivering function of the bar brush 41. Since the bar brush 41 is kept at the first position P1, paper dust adhered on the surface of the intermediate transferring belt 23 is not electrically charged by the bar brush 41. Thereby, it is possible to prevent the clogging of the bias brush 42 and bar brush 41 with the paper dust. That is, it is possible achieve lifetime extension of the cleaning device 11.

On the other hand, on the basis of deterioration of the performance of the bias brush 42, the function of the bar brush 41 is automatically delivered. Thereby, the bar brush 41 can frictionally charge the remained toner on the surface of the intermediate transferring belt 23 to a predetermined polarity (a polarity in developing process) and the bias brush 42 can effectively remove the charged remained toner. By the above-mentioned configuration, it is possible to excellently carry out the image forming on long time. Incidentally, if the whitening of the surface of the intermediate transferring belt 23 reaches a predetermined level, the paper dust is unlikely to be adhered on the surface of the intermediate transferring belt 23. Therefore, an amount of the paper dust frictionally charged by the bar brush 41 is small and a trouble that the bias brush 42 (each removing brush bristle 54) and bar brush 41 (each charging brush bristle 51) are clogged with the paper dust is unlikely to occur.

Since the brush bristles 51 and 54 are unlikely to be clogged with the paper dust, the paper dust also becomes unlikely to be accumulated on the outer circumference face of the collecting roller 43. Therefore, it is possible to prevent the clogging of the space between the collecting roller 43 and regulating sheet 45 with paper dust. Accordingly, it is possible to prevent a phenomenon in which a distal end portion of the regulating sheet 45 is floated from the outer circumference face of the collecting roller 43. Thereby, it is possible to restrain a trouble that the remained toner is reversed from the screw storing chamber 40*b* to a space at a side of the bias brush 42.

Moreover, in the color printer 1 according to the first embodiment, the intermediate transferring belt 23 carries a plurality of toner images of different colors overlapped in sequence. Therefore, an amount of the remained toner is increased. However, the bar brush 41 is moved in separating/approaching direction with respect to the surface of the intermediate transferring belt 23 in accordance with the wear of the bias brush 42. Therefore, the bias brush 42 and bar brush 41 respectively can continuously deliver the remained toner removing function. Thereby, it is possible to achieve lifetime extension of the cleaning device 11.

Talc contained in the paper dust has a property of being easily charged to minus and calcium carbonate contained in the paper dust has a property of being easily charged to plus. Therefore, if the bar brush 41 comes into contact with the surface of the intermediate transferring belt 23 before the advance of the whitening of the intermediate transferring belt 23, the talc or calcium carbonate may be adhered on each charging brush bristle 51 regardless of a charged polarity of the bar brush 41. By contrast, since the above-mentioned bar brush 41 is separated from the surface of the intermediate transferring belt 23 in a condition before the advance of the whitening, the adhesion of the paper dust with respect to each charging brush bristle 51 is effectively prevented.

(Modified Example of First Embodiment)

Although, in the color printer 1 (the cleaning device 11) according to the first embodiment as described above, the bar brush 41 at the first position P1 is separated from the surface of the intermediate transferring belt 23, the present disclosure is not restricted by this.

Figure 6:
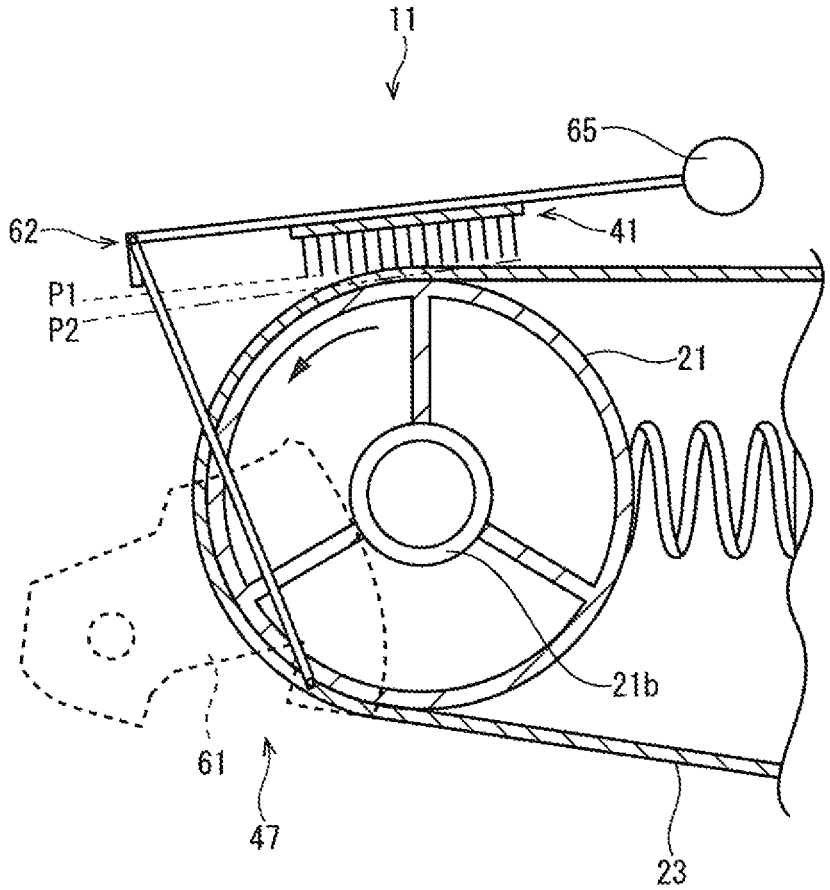
FIG. 6 is a sectional view schematically showing a part of a cleaning device of a color printer according to a modified example of the first embodiment of the present disclosure.

As shown in FIG. 6, the moving device 47 may move the bar brush 41 between a first position P1 where the bar brush 41 comes into contact with the surface of the intermediate transferring belt 23 by first pressure and a second position P2 where the bar brush 41 comes into contact with the surface of the intermediate transferring belt 23 by second pressure larger than the first pressure. In other words, according to the advance of the whitening of the surface of the intermediate transferring belt 23, the contact pressure of the bar brush 41 with the surface of the intermediate transferring belt 23 may be increased. In such a configuration, by keeping the bar brush 41 at the first position P1, a charging amount of the paper dust adhered on the surface of the intermediate transferring belt 23 is restrained. Thereby, it is possible to obtain similar action and effect to the color printer 1 according to the first embodiment.

(Second Embodiment)

Figure 7:
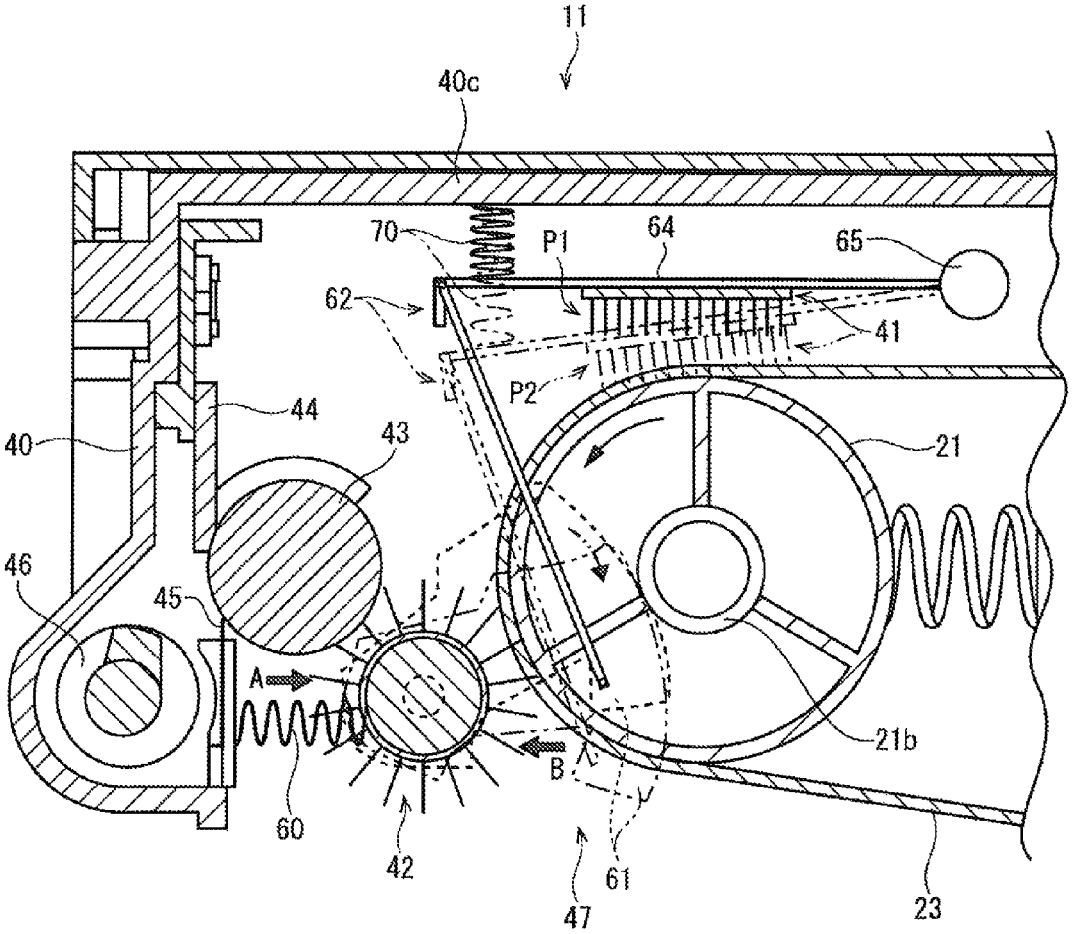
FIG. 7 is a sectional view schematically showing a cleaning device of a color printer according to a second embodiment of the present disclosure.

Next, with reference to FIG. 7, a color printer 1 according to a second embodiment will be described. FIG. 7 is a sectional view schematically showing a cleaning device 11. Components having similar or corresponding configurations to the first embodiment (including the modified example) as described above will be denoted by the same reference numerals in the figures and their explanation will be omitted.

The moving device 47 of the cleaning device 11 provided in the color printer 1 according to the second embodiment further includes a second biasing member 70 biasing the bar brush 41 to the intermediate transferring belt 23.

The second biasing member 70 is composed of so-called coil spring. The second biasing member 70 has an upper end part connected to a ceiling face 40*c* of the casing 40 and a lower end part connected to a left end part of the brush supporting part 64 of the joining member 62. The second biasing member 70 biases the bar brush 41 downwardly with respect to the ceiling face 40*c* of the casing 40 as a receiving part via the brush supporting part 64. Biasing force of the second biasing member 70 is set smaller (weaker) than pressing force of the touching member 61 biased to the rotation axis part 21*b* by the first biasing member 60.

In accordance with the color printer 1 according to the second embodiment described above, the bar brush 41 is biased with stable pressing force to the surface of the intermediate transferring belt 23 by the second biasing member 70. Thereby, the bar brush 41 can electrically charge suitably the remained toner adhered on the surface of the intermediate transferring belt 23. In accordance with such a configuration, it is possible to obtain similar action and effect to the color printer 1 according to the first embodiment. The second biasing member 70 can be suitably used for a case making the bar brush 41 come into contact with the intermediate transferring belt 23 by the first pressure as described in the modified example of the first embodiment.

(Third Embodiment)

Figure 8:
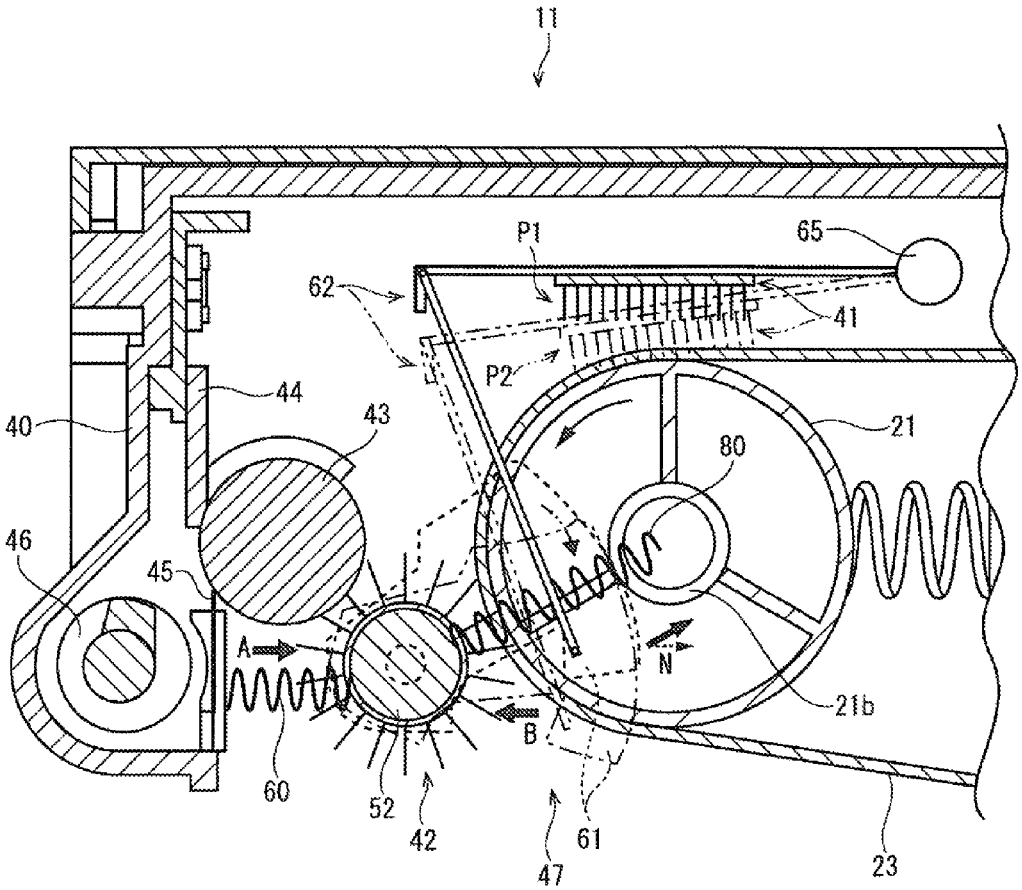
FIG. 8 is a sectional view schematically showing a cleaning device of a color printer according to a third embodiment of the present disclosure.

Next, with reference to FIG. 8, a color printer 1 according to a third embodiment will be described. FIG. 8 is a sectional view schematically showing a cleaning device 11. Components having similar or corresponding configurations to the first embodiment (including the modified example) as described above will be denoted by the same reference numerals in the figures and their explanation will be omitted.

The moving device 47 of the cleaning device 11 provided in the color printer 1 according to the third embodiment further includes a third biasing member 80 disposed between the rotation axis part 21*b* of the following roller 21 and bias brush 42 and biasing the bias brush 42 to the intermediate transferring belt 23.

The third biasing member 80 is composed of so-called coil spring. The third biasing member 80 has a left end part connected to the brush shaft 52 of the bias brush 42 and a right end part connected to an axial center part of the rotation axis part 21*b* of the following roller 21. The left end part of the third biasing member 80 may be connected to the brush shaft 52 via the touching member 61.

The sum total (A+N) of the biasing force A of the first biasing member 60 and biasing force N (correctly, horizontal component of biasing force) of the third biasing member 80 is set smaller (weaker) than the reaction force B of the bias brush 42 in the initial condition (in the new article). In such a condition ($A+N<B$), the touching member 61 is kept by the circumference face of the rotation axis part 21*b* in non-turnable state and the bar brush 41 (the joining member 62) is kept at a first position P1 (refer to a solid line and a dashed line in FIG. 8). On the other hand, in a condition where the wear of the bias brush 42 is advanced ($A+N\geq B$), the touching member 61 is turned downwardly. That is, the bar brush 41 (the joining member 62) is moved from the first position P1 to a second position P2 (a two-dot chain line in FIG. 8).

In accordance with the color printer 1 according to the third embodiment described above, the bias brush 42 is biased with stable pressing force to the surface of the intermediate transferring belt 23 by the third biasing member 80. Thereby, the bias brush 42 can suitably remove the remained toner adhered on the surface of the intermediate transferring belt 23. In accordance with such a configuration, it is possible to obtain similar action and effect to the color printer 1 according to the first embodiment. In the color printer 1 (the cleaning device 11) according to the third embodiment, each component (feature) as described in the modified example and second embodiment may be applied.

Although the moving device 47 of the cleaning device 11 provided in the color printer 1 according to the first to third embodiments is arranged at the front side, the present disclosure is not restricted by this. For example, the moving device 47 may be arranged at the back side or arranged at both front and back sides.

Although the color printer 1 according to the first to third embodiments utilizes the intermediate transferring belt 23 as the image carrier, the present disclosure is not restricted by this. For example, instead of the intermediate transferring belt 23, a photosensitive drum may be utilized as the image carrier.

Although, in the description of each embodiment, a case of applying the present disclosure to the printer 1 is illustrated as an example, the present disclosure is not restricted by this. For example, the present disclosure may be applied to another image forming apparatus, such as a monochrome printer, a copying machine, a facsimile or a multifunction peripheral.

(Fourth Embodiment)

In the following description, with reference to the figures, a cleaning device 11 according to a forth embodiment of the present disclosure will be described.

Figure 9:
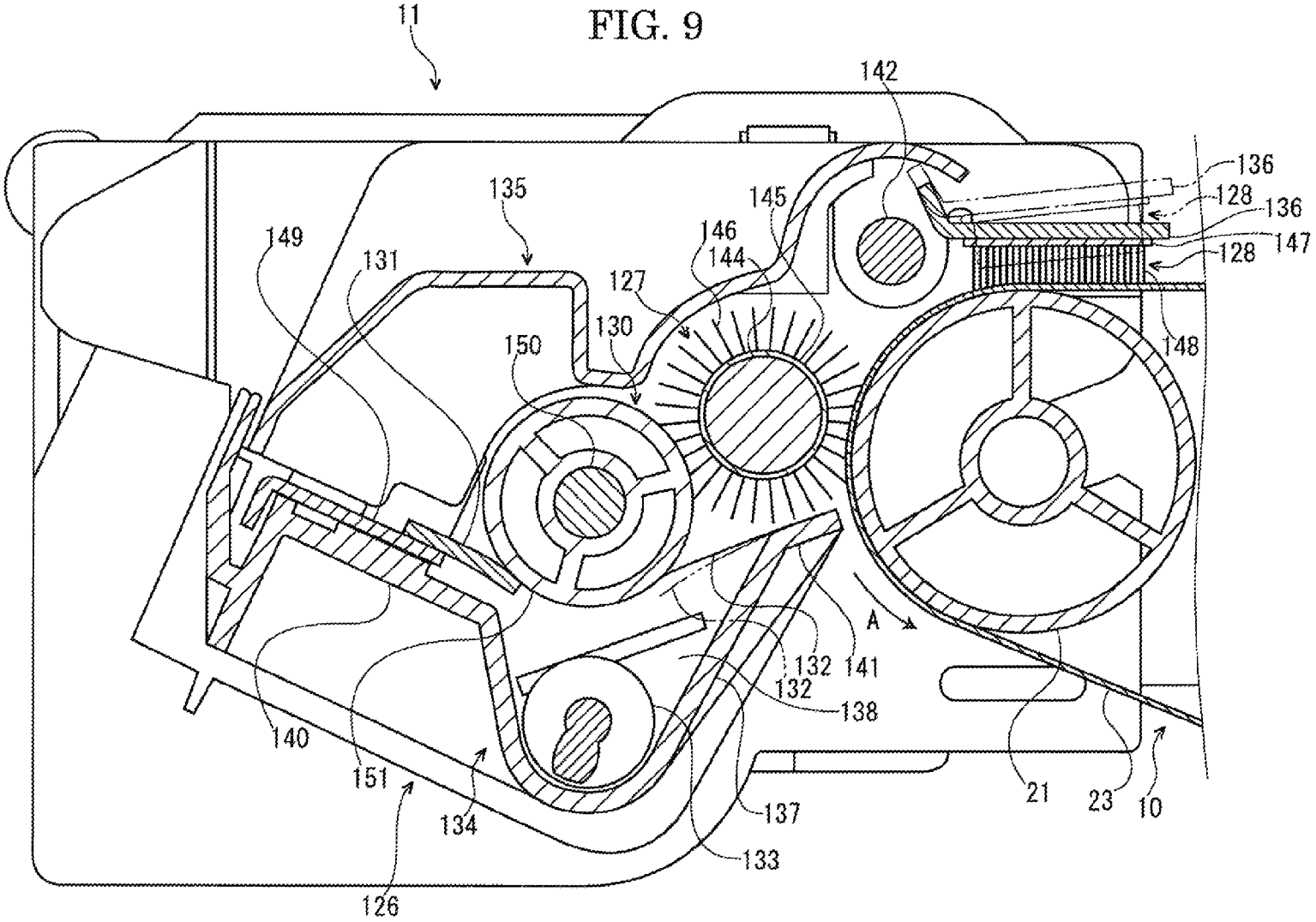
FIG. 9 is a sectional view schematically showing a cleaning device and its periphery of a color printer according to a fourth embodiment of the present disclosure.

As shown in FIG. 9, the cleaning device 11 is fixed to a left end part of the intermediate transferring unit 10 and unified with the intermediate transferring unit 10. The cleaning device 11 mainly includes a casing 126, a bias brush 127 (a cleaning member), a bar brush 128 (an auxiliary cleaning member), a collecting roller 130, a blade 131, a regulating sheet 132 and a collecting screw 133. The bias brush 127 is stored at a right side part of the casing 126. The bar brush 128 is arranged at a right upper side of the bias brush 127. The collecting roller 130 is arranged at a left lower side of the bias brush 127. The blade 131 is arranged at a left lower side of the collecting roller 130. The regulating sheet 132 is arranged at a right lower side of the collecting roller 130. The collecting screw 133 is arranged below the collecting roller 130.

The casing 126 has a main body 134, a lid body 135 arranged above the main body 134 and a swinging body 136 arranged at the right side of the lid body 135.

The main body 134 of the casing 126 is formed in a box-like shape opened at an upper side and a right side. In the main body 134, a protrusion part 137 protruding to the lower side is formed and, in a space inside the protrusion part 137, a screw storing part 138 is provided. In the main body 134, a blade attaching part 140 is formed at a left upper side of the protrusion part 137 and a sheet attaching part 141 is formed at a right upper side of the protrusion part 137.

The lid body 135 of the casing 126 covers the opening at the upper side of the main body 134. The lid body 135 is openably/closably supported by the main body 134. For example, when maintenance of the bias brush 127 or the collecting roller 130 is carried out, by opening the lid body 135, the bias brush 127 and collecting roller 130 can be exposed.

At a left end side of the swinging body 136 of the casing 126, a swinging shaft 142 is arranged and the swinging body 136 is supported by the lid body 135 via the swinging shaft 142. The swinging body 136 is configured so as to be swingable between a first posture (refer to a solid line in FIG. 9) being roughly horizontal and a second posture (refer to a two-dot chain line in FIG. 9) inclined slightly upwardly toward the right side around the swinging shaft 142

The bias brush 127 faces to the following roller 21 across the intermediate transferring belt 23. The bias brush 127 has a brush shaft 144, a cylindrical body 145 provided around the brush shaft 144 and a plurality of brush yarns 146 implanted on an outer circumference face of the cylindrical body 145.

The brush shaft 144 of the bias brush 127 is extended in the forward and backward directions. Both front and rear end parts of the brush shaft 144 are pivotally supported by the main body 134 of the casing 126. Thereby, the bias brush 127 is rotatably supported by the casing 126. The cylindrical body 145 of the bias brush 127 is fitted onto an outer circumference face of the brush shaft 144. Each brush yarn 146 of the bias brush 127 is made of electroconductive yarn. Concretely, each brush yarn 146 is preferably made of polyester-based, nylon-based or acryl-based yarn. A distal end portion of each brush yarn 146 comes into contact with the surface of the intermediate transferring belt 23.

The bar brush 128 is arranged at an upstream side from the bias brush 127 in the rotating direction (refer to an arrow A in FIG. 9) of the intermediate transferring belt 23. The bar brush 128 faces to the following roller 21 across the intermediate transferring belt 23. The bar brush 128 has a base part 147 and a plurality of brush bristles 148 implanted on a lower face of the base part 147.

The base part 147 of the bar brush 128 is made of, for example, synthetic resin material. The base part 147 is fixed to a lower face of the swinging body 136 of the casing 126. Thereby, the bar brush 128 is configured so as to be swingable together with the swinging body 136. Each brush bristle 148 of the bar brush 128 is made of, for example, insulating yarn. Concretely, each brush bristle 148 is preferably made of polyester-based or acryl-based yarn. When the toner is electrically charged to a predetermined polarity, it is preferable that each brush bristle 148 is positioned (electrically charged) at a reversed side to the predetermined polarity from the toner in a charging series. For example, in a case where the toner is a positive charged toner, it is preferable that each brush bristle 148 is positioned (electrically charged) at a minus side from the toner in the charging series. A distal end portion (a lower end part) of each brush bristle 148 comes into contact with the surface of the intermediate transferring belt 23 in a condition where the swinging body 136 of the casing 126 takes the first posture (refer to a solid line in FIG. 9).

The collecting roller 130 has a roller shaft 150 and a roller main body 151 provided around the roller shaft 150.

The roller shaft 150 of the collecting roller 130 is extended in the forward and backward directions. Both front and rear end parts of the roller shaft 150 are pivotally supported by the main body 134 of the casing 126. Thereby, the collecting roller 130 is rotatably supported by the casing 126. The roller main body 151 of the collecting roller 130 is made of, for example, rubber or soft synthetic resin. An outer circumference face of the roller main body 151 comes into contact with each brush yarn 146 of the bias brush 127.

The blade 131 is, for example, formed in a plate-like shape and made of synthetic resin. The blade 131 is arranged in a posture inclined toward a right lower side. A proximal end portion (a left end part) of the blade 131 is attached to the blade attaching part 140 of the main body 134 of the casing 126 via an attachment 149. A distal end portion (a right end part) of the blade 131 comes into contact with the outer circumference face of the roller main body 151 of the collecting roller 130.

The regulating sheet 132 is composed of, for example, a film. The regulating sheet 132 is arranged in a posture inclined toward a left lower side. A proximal end portion (a right end part) of the regulating sheet 132 is attached to the sheet attaching part 141 of the main body 134 of the casing 126. A distal end portion (a left end part) of the regulating sheet 132 comes into contact with the outer circumference face of the roller main body 151 of the collecting roller 130. The regulating sheet 132 is configured so as to partition the screw storing part 138 of the main body 134 of the casing 126 with respect to a space of a side of the bias brush 127.

The collecting screw 133 is stored in the screw storing part 138 of the main body 134 of the casing 126. The collecting screw 133 is formed in an elongated shape in the forward and backward directions. The collecting screw 133 is connected to a collecting box (not shown).

Figure 10:
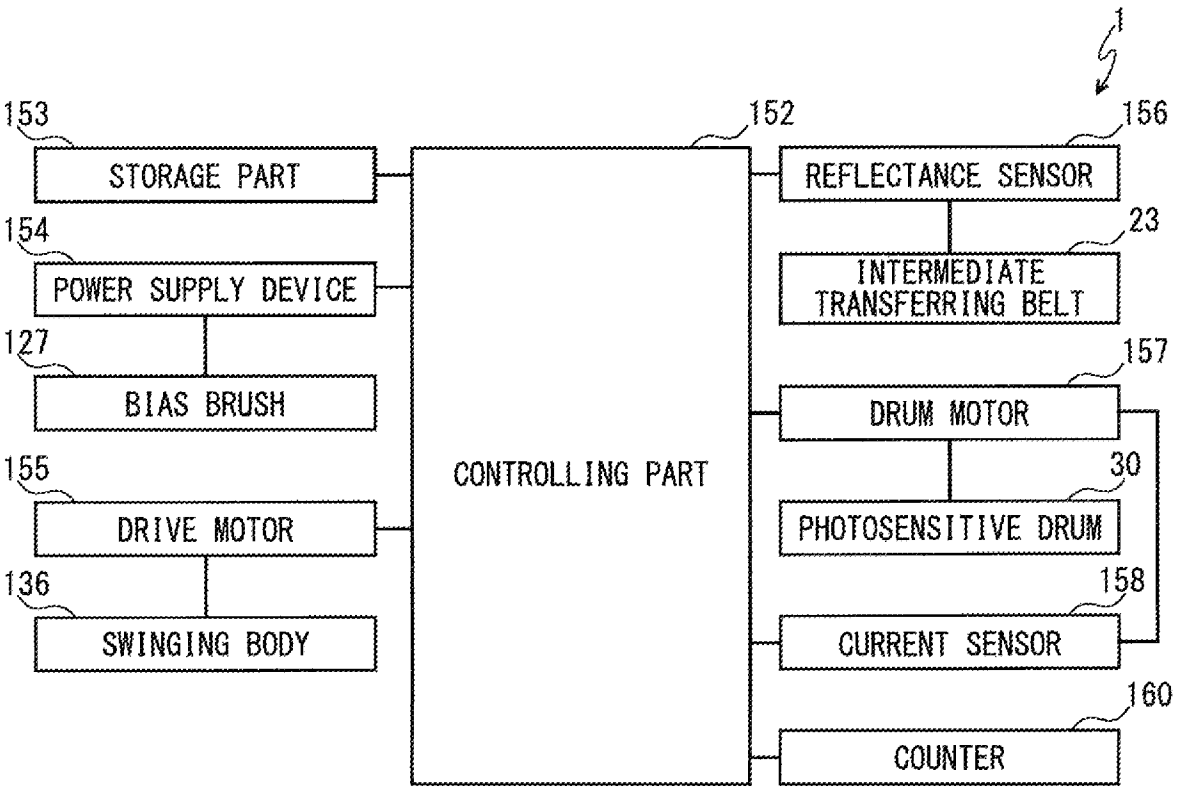
FIG. 10 is a block diagram showing an electric structure of the color printer according to the fourth embodiment of the present disclosure.

Next, an electric structure of the color printer 1 will be described with reference to FIG. 10.

The color printer 1 includes a controlling part 152 (CPU: Central Processing Unit). The controlling part 152 is connected to a storage part 153 composed of a storage device, such as a ROM or a RAM. The controlling part 152 is configured so as to control each component of the color printer 1 on the basis of a control program or control data stored in the storage part 153. In the storage part 153, a threshold Rth of reflectance of the surface of the intermediate transferring belt 23 is stored. The threshold Rth is varied with a destination of the color printer 1.

The controlling part 152 is connected to a power supply device 154 and the power supply device 154 is connected to the bias brush 127. The power supply device 154 is configured so as to apply a bias to the bias brush 127 on the basis of a signal from the controlling part 152.

The controlling part 152 is connected to a drive motor 155 and the drive motor 155 is connected to the swinging body 136. The drive motor 155 is configured so as to swing the swinging body 136 on the basis of a signal from the controlling part 152.

The controlling part 152 is connected to a reflectance sensor 156 (a whitening information acquiring part). The reflectance sensor 156 is configured so as to sense (acquires) the reflectance of the surface of the intermediate transferring belt 23 (information relating to the whitening of the surface of the intermediate transferring belt 23) and to output such sensed information to the controlling part 152. As the reflectance sensor 156, a sensor composed of a light emitting part emitting a sensing light to the surface of the intermediate transferring belt 23 and a light receiving part receiving the sensing light reflected by the surface of the intermediate transferring belt 23 can be applied. As a signal sensing the reflectance, a P wave (a regular reflection light), an S wave (a diffused reflection light), an L value, a gloss or the like can be applied.

The controlling part 152 is connected to a drum motor 157 (a drive source) and the drum motor 157 is connected to each photosensitive drum 30 (each contacting member). The drum motor 157 is configured so as to rotate each photosensitive drum 30 on the basis of a signal from the controlling part 152.

The controlling part 152 is connected to a current sensor 158. The current sensor 158 is configured so as to sense a current flowing to the drum motor 157 and to output such sensed information to the controlling part 152.

The controlling part 152 is connected to a counter 160. The counter 160 has a function counting the number of use of the intermediate transferring belt 23 during a time elapsed after new intermediate transferring unit 10 is installed to the apparatus main body 2.

A way of removing the remained toner from the surface of the intermediate transferring belt 23 by the cleaning device 11 in the color printer 1 configured as mentioned above will be described. Incidentally, a condition where the swinging body 136 is kept in the first posture (refer to the solid line in FIG. 9) and each brush bristle 148 of the bar brush 128 comes into contact with the surface of the intermediate transferring belt 23 will be described as an example.

In order to remove the remained toner (here, the "positive charged toner" is assumed) from the surface of the intermediate transferring belt 23, the bias of the negative polarity (the reversed polarity to the polarity of the remained toner) is applied from the power supply device 154 to the bias brush 127. In such a situation, when the intermediate transferring belt 23 is rotated in a direction indicated by the arrow A in FIG. 9, the remained toner comes into contact with each brush bristle 148 of the bar brush 128. Even if the remained toner is charged to the negative polarity or the polarity of the remained toner is extremely close to zero, by making the remained toner come into contact with each brush bristle 148 of the bar brush 128 as mentioned above, the remained toner becomes easy to be charged to the positive polarity.

After the remained toner comes into contact with each brush bristle 148 of the bar brush 128 as mentioned above, the remained toner comes into contact with each brush yarn 146 of the bias brush 127. At that time, electrostatic adsorption force is acted between each brush yarn 146 of the bias brush 127 and the remained toner, and then, the remained toner adhered on the surface of the intermediate transferring belt 23 is shifted to each brush yarn 146 of the bias brush 127. According to this, the remained toner is removed from the surface of the intermediate transferring belt 23.

After that, the remained toner is shifted from each brush yarn 146 of the bias brush 127 to the roller main body 151 of the collecting roller 130, scraped from the roller main body 151 of the collecting roller 130 by the blade 131, and then, shifted to the screw storing part 138. The remained toner shifted to the screw storing part 138 is conveyed to the collecting box (not shown) by the collecting screw 133.

Next, a way of making each brush bristle 148 of the bar brush 128 come into contact with the surface of the intermediate transferring belt 23 at a predetermined timing in the color printer 1 configured as mentioned above will be described.

At the start of use of the intermediate transferring belt 23 (when a use counter of the intermediate transferring unit 10 indicates zero), the swinging body 136 is kept in the second posture (refer to a two-dot chain line in FIG. 9) and each brush bristle 148 of the bar brush 128 is separated from the surface of the intermediate transferring belt 23.

When the use of the intermediate transferring belt is started, the reflectance sensor 156 senses the reflectance of the surface of the intermediate transferring belt 23 and outputs the sensed information to the controlling part 152. The controlling part 152 decides on the basis of the sensed information outputted from the reflectance sensor 156 whether or not the whitening of the surface of the intermediate transferring belt 23 reaches a predetermined level. Concretely, as the surface of the intermediate transferring belt 23 is whitened, since diffused reflection easily occurs on the surface of the intermediate transferring belt 23, the reflectance of the surface of the intermediate transferring belt 23 is decreased. Thereupon, the controlling part 152 decides, in a case where the reflectance of the surface of the intermediate transferring belt 23 sensed by the reflectance sensor 156 exceeds the threshold Rth stored in the storage part 153, that the whitening of the surface of the intermediate transferring belt 23 does not reach the predetermined level. On the other hand, the controlling part 152 decides, in a case where the reflectance of the surface of the intermediate transferring belt 23 sensed by the reflectance sensor 156 becomes equal to or less than the threshold Rth stored in the storage part 153, that the whitening of the surface of the intermediate transferring belt 23 reaches the predetermined level.

While the controlling part 152 decides that the whitening of the surface of the intermediate transferring belt 23 does not reach the predetermined level, the swinging body 136 is kept in the second posture (refer to the two-dot chain line in FIG. 9) and each brush bristle 148 of the bar brush 128 is separated from the surface of the intermediate transferring belt 23.

At the stage when the whitening of the surface of the intermediate transferring belt 23 does not reach the predetermined level, functionality of the bias brush 127 is relatively high. Therefore, without making each brush bristle 148 of the bar brush 128 come into contact with the surface of the intermediate transferring belt 23, it is possible to remove the remained toner from the surface of the intermediate transferring belt 23 by each brush yarn 146 of the bias brush 127 and to achieve image quality enhancement of an output image. In addition, at the stage when the whitening of the surface of the intermediate transferring belt 23 does not reach the predetermined level, although a large quantity of paper dusts are adhered on the surface of the intermediate transferring belt 23, by separating each brush bristle 148 of the bar brush 128 from the surface of the intermediate transferring belt 23, it is possible to prevent the paper dust adhered on the surface of the intermediate transferring belt 23 from being frictionally charged by each brush bristle 148 of the bar brush 128. Therefore, it is possible to prevent the paper dust from adhering on and clogging each brush bristle 148 of the bar brush 128 and each brush yarn 146 of the bias brush 127 and to achieve lifetime extension of the cleaning device 11.

On the other hand, after the controlling part 152 decides that the whitening of the surface of the intermediate transferring belt 23 reaches the predetermined level, the drive motor 155 swings the swinging body 136 from the second posture (refer to the two-dot chain line in FIG. 9) to the first posture (refer to the solid line in FIG. 9) on the basis of the signal from the controlling part 152. According to this, each brush bristle 148 of the bar brush 128 comes into contact with the surface of the intermediate transferring belt 23. Thus, in the embodiment, according to the advance of the whitening of the surface of the intermediate transferring belt 23, the bar brush 128 is made to come into contact with the surface of the intermediate transferring belt 23.

After the whitening of the surface of the intermediate transferring belt 23 reaches the predetermined level by the use of the intermediate transferring belt 23, although the functionality of the bias brush 127 is deteriorated, by making each brush bristle 148 of the bar brush 128 come into contact with the surface of the intermediate transferring belt 23, the remained toner becomes easy to be frictionally charged to the positive polarity. According to this, it is possible to securely remove the remained toner from the surface of the intermediate transferring belt 23 by each brush yarn 146 of the bias brush 127 and to achieve the image quality enhancement of the output image. When the whitening of the surface of the intermediate transferring belt 23 reaches the predetermined level, the paper dust is unlikely to be adhered on the surface of the intermediate transferring belt 23. Therefore, if each brush bristle 148 of the bar brush 128 is made to come into contact with the surface of the intermediate transferring belt 23, an amount of the paper dust frictionally charged by each brush bristle 148 of the bar brush 128 is small and a trouble that each brush yarn 146 of the bias brush 127 and each brush bristle 148 of the bar brush 128 are clogged with the paper dust is unlikely to occur.

As described above, in the embodiment, by making each brush bristle 148 of the bar brush 128 come into contact with the surface of the intermediate transferring belt 23 at a suitable timing, it is possible to securely remove the remained toner from the surface of the intermediate transferring belt 23 and to achieve lifetime extension of the cleaning device 11.

Moreover, since the paper dust is unlikely to be adhered on each brush yarn 146 of the bias brush 127 and each brush bristle 148 of the bar brush 128 as mentioned above, the paper dust becomes unlikely to be accumulated on the outer circumference face of the roller main body 151 of the collecting roller 130. According to this, it is possible to prevent the paper dust from clogging between the outer circumference face of the roller main body 151 of the collecting roller 130 and the distal end portion of the regulating sheet 132. Therefore, it is possible to prevent a phenomenon (refer to a two-dot chain line in FIG. 9) in which the distal end portion of the regulating sheet 132 is floated from the outer circumference face of the roller main body 151 of the collecting roller 130. Thereby, it is possible to restrain a trouble that the remained toner in the screw storing part 138 is reversed to a space at a side of the bias brush 127.

In the embodiment, without applying voltage to the bar brush 128, the remained toner is removed from the surface of the intermediate transferring belt 23. Therefore, high voltage power source applying voltage to the bar brush 128 becomes unnecessary, and then, it is possible to simplify the configuration of the color printer 1.

In talc and calcium carbonate contained in the paper dust, the talc has a property of being easily charged to minus and the calcium carbonate has a property of being easily charged to plus. Therefore, even if the bar brush 128 is charged to any one polarity of plus and minus, as long as each brush bristle 148 of the bar brush 128 is made to come into contact with the surface of the intermediate transferring belt 23 before the whitening of the surface of the intermediate transferring belt 23 reaches the predetermined level, one of the talc and calcium carbonate may be necessarily adhered on each brush bristle 148 of the bar brush 128. By contrast, in the embodiment, since each brush bristle 148 of the bar brush 128 is separated from the surface of the intermediate transferring belt 23 at the stage before the whitening of the surface of the intermediate transferring belt 23 reaches the predetermined level, it is possible to securely prevent the adhesion of the paper dust onto each brush bristle 148 of the bar brush 128.

Particularly, the color printer 1 of the embodiment uses the intermediate transferring belt 23 as the image carrier. In such a case, since the toner images are overlapped on the surface of the intermediate transferring belt 23, an amount of the remained toner adhered on the surface of the intermediate transferring belt 23 is increased. Therefore, it is preferable to use the above-mentioned configuration in order to securely remove the remained toner from the surface of the intermediate transferring belt 23.

In the embodiment, the threshold Rth of the reflectance of the surface of the intermediate transferring belt 23 is varied with the destination of the color printer 1. For example, with respect to the color printer 1 provided in the destination of a region where the sheet easily generating the paper dust is often used, the threshold Rth is set low, and then, the time until each brush bristle 148 of the bar brush 128 comes into contact with the surface of the intermediate transferring belt 23 is lengthened. By applying such a configuration, it is possible to make each brush bristle 148 of the bar brush 128 come into contact with the surface of the intermediate transferring belt 23 at a suitable timing according to the destination.

In the embodiment, the reflectance sensor 156 sensing the reflectance of the surface of the intermediate transferring belt 23 is used as the whitening information acquiring part. By applying such a configuration, it is possible to securely decide on the basis of the reflectance of the surface of the intermediate transferring belt 23 whether or not the whitening of the surface of the intermediate transferring belt 23 reaches the predetermined level.

Although, in the embodiment, a case of using the reflectance sensor 156 as the whitening information acquiring part was described, in another embodiment, the current sensor 158 may be used as the whitening information acquiring part. Concretely, as the surface of the intermediate transferring belt 23 is whitened, μ (a friction coefficient) of the surface of the intermediate transferring belt 23 is decreased and drive torque of the drum motor 157 is also decreased, and then, a current value of the drum motor 157 is decreased. Thereupon, the controlling part 152 decides, in a case where the current value of the drum motor 157 sensed by the current sensor 158 exceeds a predetermined threshold, that the whitening of the surface of the intermediate transferring belt 23 does not reach the predetermined level. On the other hand, the controlling part 152 decides, in a case where the current value of the drum motor 157 sensed by the current sensor 158 becomes equal to or less than the predetermined threshold, that the whitening of the surface of the intermediate transferring belt 23 reaches the predetermined level. By applying such a configuration, it is possible to securely decide on the basis of the current value of the drum motor 157 whether or not the whitening of the surface of the intermediate transferring belt 23 reaches the predetermined level. In such a case where the current sensor 158 is used as the whitening information acquiring part, a current value of a motor (a drive source) rotating the intermediate transferring belt 23 may be sensed by the current sensor 158.

Although, in the embodiment, a case of using the reflectance sensor 156 as the whitening information acquiring part was described, in another embodiment, the counter 160 may be used as the whitening information acquiring part. Concretely, a level of the whitening of the surface of the intermediate transferring belt 23 rises in accordance with the number of the use of the intermediate transferring belt 23. Thereupon, the controlling part 152 decides, in a case where the number of the use of the intermediate transferring belt 23 counted by the counter 160 is smaller than a predetermined threshold, that the whitening of the surface of the intermediate transferring belt 23 does not reach the predetermined level. On the other hand, the controlling part 152 decides, in a case where the number of the use of the intermediate transferring belt 23 counted by the counter 160 becomes equal to or more than the predetermined threshold, that the whitening of the surface of the intermediate transferring belt 23 reaches the predetermined level. By applying such a configuration, it is possible to securely decide on the basis of the number of the use of the intermediate transferring belt 23 whether or not the whitening of the surface of the intermediate transferring belt 23 reaches the predetermined level.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

an image carrier being rotated to carry a toner image; and a cleaning device including:

a cleaning member to which a bias of a reversed polarity to a polarity of a remained toner adhered on a surface of the image carrier is applied, and an auxiliary cleaning member located at an upstream side from the cleaning member in a rotating direction of the image carrier, wherein, according to advance of whitening of the surface of the image carrier, the auxiliary cleaning member is made to come into contact with the surface of the image carrier or contact pressure of the auxiliary cleaning member with the surface of the image carrier is increased, the image forming apparatus further comprising:

a moving device moving the auxiliary cleaning member between a first position where the auxiliary cleaning member is separated from the surface of the image carrier or comes into contact with the surface of the image carrier by first pressure and a second position where the auxiliary cleaning member comes into contact with the surface of the image carrier by second pressure larger than the first pressure, wherein the cleaning member is arranged so that its center is positioned lower than a rotation center of a rotation axis part of the image carrier, the moving device includes:

a first biasing member biasing the cleaning member to make the cleaning member come into contact with the surface of the image carrier;

a touching member having one end part turnably connected to the cleaning member and another end part coming into contact with the rotation axis part of the image carrier; and a joining member joining the touching member and auxiliary cleaning member, in a case where a reaction force acting between the cleaning member and the image carrier on the basis of an elastic force of the cleaning member is larger than a biasing force of the first biasing member, the touching member is pressed to the rotation axis part in non-turnable state by the reaction force and keeps the auxiliary cleaning member to the first position via the joining member, in a case where the reaction force becomes equal to or less than the biasing force of the first biasing member according to the advance of the whitening of the surface of the image carrier, the touching member is turned downwardly and moves the auxiliary cleaning member from the first position to the second position via the joining member.

2. The image forming apparatus according to claim 1, wherein the moving device further includes a second biasing member biasing the auxiliary cleaning member to the image carrier.

3. The image forming apparatus according to claim 1, wherein the moving device further includes a third biasing member disposed between the rotation axis part of the image carrier and the cleaning member and biasing the cleaning member to the image carrier.

4. The image forming apparatus according to claim 1 further comprising:

a plurality of photosensitive bodies carrying toner images of different colors, wherein the image carrier is an intermediate transferring belt wound around a plurality of rollers to carry the toner images transferred from the photosensitive bodies, the auxiliary cleaning member has a charging brush bristle implanted on a lower face of a base part, the cleaning member has a removing brush bristle implanted on an outer circumference face of a cylindrical body rotated around an axis.

5. The image forming apparatus according to claim 4, wherein rigidity of the removing brush bristle is set lower than rigidity of the charging brush bristle.

6. The image forming apparatus according to claim 1, wherein the joining member has:

an arm part turnably joined to the touching member; and a brush supporting part turnably joined to the arm part, the auxiliary cleaning member is supported by the brush supporting part.

7. The image forming apparatus according to claim 6, wherein an angle between the arm part and brush supporting part is an acute angle.

8. The image forming apparatus according to claim 1 further comprising:

a plurality of photosensitive bodies, on which toner images of different colors are formed, wherein the image carrier is an intermediate transferring belt on which the toner images formed on the photosensitive bodies are transferred.

9. The image forming apparatus according to claim 1, wherein the cleaning member has:

a brush shaft;

a cylindrical body provided around the brush shaft; and a brush yarn implanted on an outer circumference face of the cylindrical body.

10. The image forming apparatus according to claim 1, wherein the cleaning device further includes a casing storing the cleaning member, the casing has a swinging body swingable around a swinging shaft, the auxiliary cleaning member has:

a base part fixed to the swinging body; and a brush bristle implanted on the base part.

11. An image forming apparatus comprising:

an image carrier being rotated to carry a toner image; and a cleaning device including:

a cleaning member to which a bias of a reversed polarity to a polarity of a remained toner adhered on a surface of the image carrier is applied, and an auxiliary cleaning member located at an upstream side from the cleaning member in a rotating direction of the image carrier, wherein, according to advance of whitening of the surface of the image carrier, the auxiliary cleaning member is made to come into contact with the surface of the image carrier or contact pressure of the auxiliary cleaning member with the surface of the image carrier is increased, the image forming apparatus further comprising:

a whitening information acquiring part acquiring information relating to the whitening of the surface of the image carrier; and a controlling part deciding on the basis of information outputted from the whitening information acquiring part whether or not the whitening of the surface of the image carrier reaches a predetermined level, wherein, while the controlling part decides that the whitening of the surface of the image carrier does not reach the predetermined level, the auxiliary cleaning member is separated from the surface of the image carrier, and, after the controlling part decides that the whitening of the surface of the image carrier reaches the predetermined level, the auxiliary cleaning member is made to come into contact with the surface of the image carrier, the image forming apparatus further comprising:

a contacting member coming into contact with the surface of the image carrier; and a drive source rotating the image carrier or the contacting member, wherein the whitening information acquiring part is a current sensor sensing a current value of the drive source, the controlling part decides, in a case where the current value of the drive source sensed by the current sensor becomes equal to or less than a threshold, that the whitening of the surface of the image carrier reaches the predetermined level.

12. An image forming apparatus comprising:

an image carrier being rotated to carry a toner image; and a cleaning device including:

a cleaning member to which a bias of a reversed polarity to a polarity of a remained toner adhered on a surface of the image carrier is applied, and an auxiliary cleaning member located at an upstream side from the cleaning member in a rotating direction of the image carrier, wherein, according to advance of whitening of the surface of the image carrier, the auxiliary cleaning member is made to come into contact with the surface of the image carrier or contact pressure of the auxiliary cleaning member with the surface of the image carrier is increased, the image forming apparatus further comprising:

a whitening information acquiring part acquiring information relating to the whitening of the surface of the image carrier;

a controlling part deciding on the basis of information outputted from the whitening information acquiring part whether or not the whitening of the surface of the image carrier reaches a predetermined level, wherein, while the controlling part decides that the whitening of the surface of the image carrier does not reach the predetermined level, the auxiliary cleaning member is separated from the surface of the image carrier, and, after the controlling part decides that the whitening of the surface of the image carrier reaches the predetermined level, the auxiliary cleaning member is made to come into contact with the surface of the image carrier, wherein the whitening information acquiring part is a reflectance sensor sensing reflectance of the surface of the image carrier, the controlling part decides, in a case where the reflectance of the surface of the image carrier sensed by the reflectance sensor becomes equal to or less than a threshold, that the whitening of the surface of the image carrier reaches the predetermined level, the image forming apparatus further comprising a storage part storing the threshold varied with a destination of the image forming apparatus.

* * * * *